US005752438A

United States Patent [19]

Hartmann et al.

[11] Patent Number: 5,752,438

[45] Date of Patent: May 19, 1998

[54] FILTER ENVELOPE FOR A DRAINAGE ELEMENT FOR PRESSES USED FOR SEPARATING FLUIDS FROM SOLID MATERIALS

[75] Inventors: Eduard Hartmann, Schneisingen; Alexandr Chara, Neuhausen, both of Switzerland

[73] Assignee: Bucher-Guyer AG, Niederwenigen, Switzerland

[21] Appl. No.: 714,130

[22] PCT Filed: Jan. 8, 1996

[86] PCT No.: PCT/CH96/00005

§ 371 Date: Sep. 16, 1996

§ 102(e) Date: Sep. 16, 1996

[87] PCT Pub. No.: WO96/22185

PCT Pub. Date: Jul. 25, 1996

[30] Foreign Application Priority Data

Jan. 16, 1995 [CH] Switzerland ..... 115/95

[51] Int. Cl.[6] ..... B30B 9/02

[52] U.S. Cl. ..... 100/107; 100/125

[58] Field of Search ..... 100/107–109, 100/116, 125

[56] References Cited

U.S. PATENT DOCUMENTS

| | | | |
|---|---|---|---|
| 3,103,164 | 9/1963 | Willmes | 100/107 |
| 3,207,064 | 9/1965 | Hauser-Bucher | 100/107 |
| 5,054,952 | 10/1991 | Chara | 100/107 |
| 5,130,022 | 7/1992 | Chara . | |
| 5,361,691 | 11/1994 | Hartmann | 100/107 |
| 5,582,100 | 12/1996 | Pinnow | 100/107 |

FOREIGN PATENT DOCUMENTS

| | | | |
|---|---|---|---|
| 0356914 | 3/1990 | European Pat. Off. | 100/116 |
| 1152886 | 8/1963 | Germany . | |
| 413599 | 12/1966 | Switzerland | 100/107 |
| 0414172 | 2/1991 | WIPO . | |

*Primary Examiner*—Stephen F. Gerrity
*Attorney, Agent, or Firm*—Burns, Doane, Swecker & Mathis, L.L.P.

[57] ABSTRACT

A filter envelope (26) for a rod-shaped, flexible drainage core (4) with flow paths (5) for removing the pressed-out fluid from the pressing chamber of a press. By winding the filter envelope (26) itself around it, a ring-shaped bulge (20) is fixedly connected with it (26) for assembling the filter envelope (26) and the drainage core (4) on one or both ends of the press.

20 Claims, 7 Drawing Sheets

FILTER ENVELOPE FOR A DRAINAGE ELEMENT FOR PRESSES USED FOR SEPARATING FLUIDS FROM SOLID MATERIALS

FIELD OF THE INVENTION

The invention relates to a filter envelope for a drainage element for presses used for separating fluids from solid materials, in particular for fruit presses, wherein the drainage element comprises a rod-shaped flexible drainage core with flow paths for removing the pressed-out liquid from the pressing chamber of the press and a fluid-permeable envelope surrounding the drainage core, and wherein at least one end of the drainage element is fastened on a juice collecting plate, pressure plate or the pressure jacket of the press.

BACKGROUND OF THE INVENTION

FIG. 1 shows a longitudinal sectional view through the known fastening of a drainage element on a fruit press. A plurality of drainage elements 3 are disposed in a pressing chamber 2, delimited by respectively one pressure plate 1, of a known fruit press, not shown.

A drainage element 3 essentially consists of an elastic drainage core 4, through whose outside located grooves 5 as shown by the section IA—IA in FIG. 1A the liquid is guided out of the pressing chamber 2 during the pressing operation, and of a stocking-shaped filter 6 placed over it for separating the solids from the liquids. The drainage core 4 and the filter 6 are fastened in a core holder 7 at the respective ends of the drainage element 3. In this case the filter 6 is placed over an elastic sleeve 8 and is fixed in place by means of an O-ring 9. A disk 10 is used for supporting the sleeve 8 on a transverse pin 11 which is laterally pushed into bores of the drainage core 4 and the core holder 7 and in this way assures the axial and radial fixation of the two components 4 and 7 in respect to each other.

The core holder 7 is connected by means of a spacer bushing 12 and a safety ring 13 with the pressure plate 1. In this case a protrusion 14 of the safety ring 13 which engages a groove of the core holder 7 through a slit in the spacer bushing 12, together with a collar 17 of the spacer bushing located behind the pressure plate 1, provides security against axial displacement.

As can be seen in FIG. 1, the filter 6 is held in the spacer bushing 12 by being clamped between the core holder 7, the sleeve 8 and the O-ring 8. At least the sleeve 8 is made of an elastically deformable material, preferably an elastomer. In this known embodiment the drainage filters 6 are produced by means of a knitting process and, to prevent runs, are provided with darts or cut under heat so that the stitches slightly melt and stick together at the ends near the disk 10.

This type of construction has the following disadvantages:

The assembly of the filter element 6 with the complete drainage element 3 is very labor-intensive. The filter 6 is pulled over the sleeve 8 and must be correctly placed in the longitudinal direction. Then the O-ring is pushed over it and must be clamped in the core holder 7 together with the drainage core 4. In the course of this, the following assembly errors occur as a rule: - formation of runs because of excessive pulling, - wrong placement in the longitudinal direction, - the O-ring is displaced during the insertion, - use of lubricants, although this is impermissible. These errors can result in insufficient fastening of the filter 6 in the connecting part. During operation the filter 6 is then pulled out from beneath the O-ring 9 and the operation of the press is hampered.

A problem also arises during disassembly of the filters 6 worn out through normal use, because in some cases the O-ring 9 is seated very solidly and therefore makes disassembly more difficult.

SUMMARY OF THE INVENTION

It is the object of the invention to avoid the disadvantages mention by means of a filter envelope of the type mentioned at the outset.

This object is attained in accordance with the invention by at least one ring-like bulge which is fixedly connected to the filter envelope at its one end by being surrounded by the filter envelope itself or by means of an extension connected therewith and can be deformed in such a way that it permits the respective end of the filter envelope to be pushed through an opening in a fastening element whose diameter is maximally equal to the diameter of the filter envelope in its form in which it is fastened on the press.

In this case it has been shown to be particularly advantageous if the ring-shaped bulge consists of a ring and the end of the filter envelope is wound around the ring and fastened on an area of the filter envelope located ahead of the end.

In accordance with another embodiment it is provided that the ring-shaped bulge consists of a plurality of rings and that the end of the filter envelope is wound around the ring and fastened on a area of the filter envelope located ahead of the end. The ring-shaped bulge can be formed in a particularly simple manner by rolling up and sewing together the respective end of the filter envelope itself or an extension formed thereon. Further embodiments of the invention are characterized in the claims.

BRIEF DESCRIPTION OF THE DRAWING FIGURES

The invention is explained in more detail in the following description and the drawings, which represent exemplary embodiments.

FIG. 1, a sectional view of a known fastening of a drainage element on the pressure plate of a fruit press, FIG. 1A is a cross-sectional view along the section line IA—IA in FIG. 1;

FIG. 2, a sectional view of a filter envelope in accordance with the invention and an associated holding body for explaining the assembly on a pressure plate of a fruit press, FIG. 2A is a cross-sectional view along the section line IIA—IIA in FIG. 2;

DETAILED DESCRIPTION OF THE INVENTION

Figures 1, 1A:
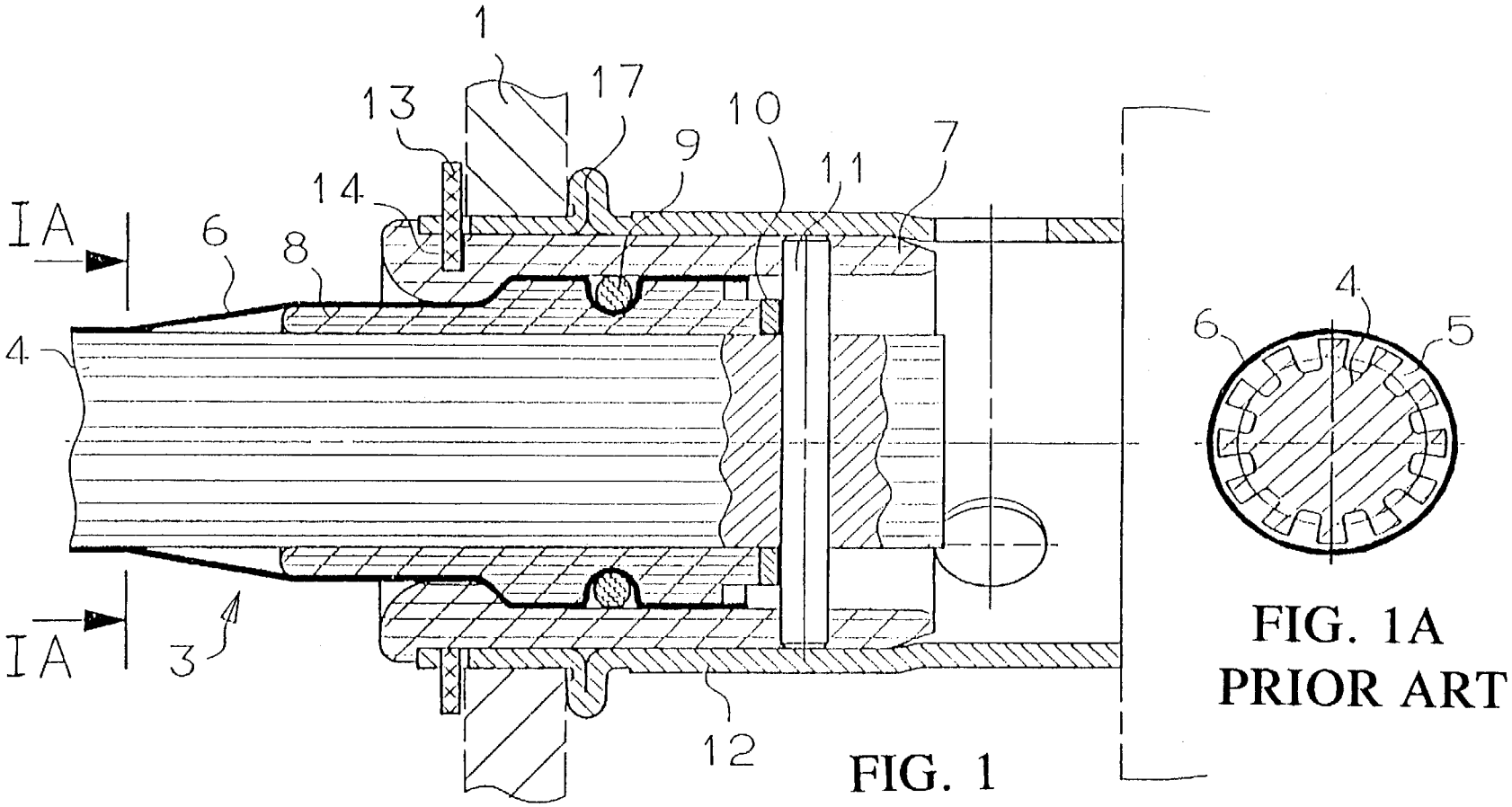
FIG. 1A PRIOR ART
FIG. 1 PRIOR ART
Figure 2A:
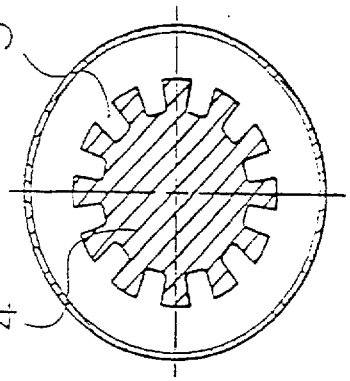
Figure 2:
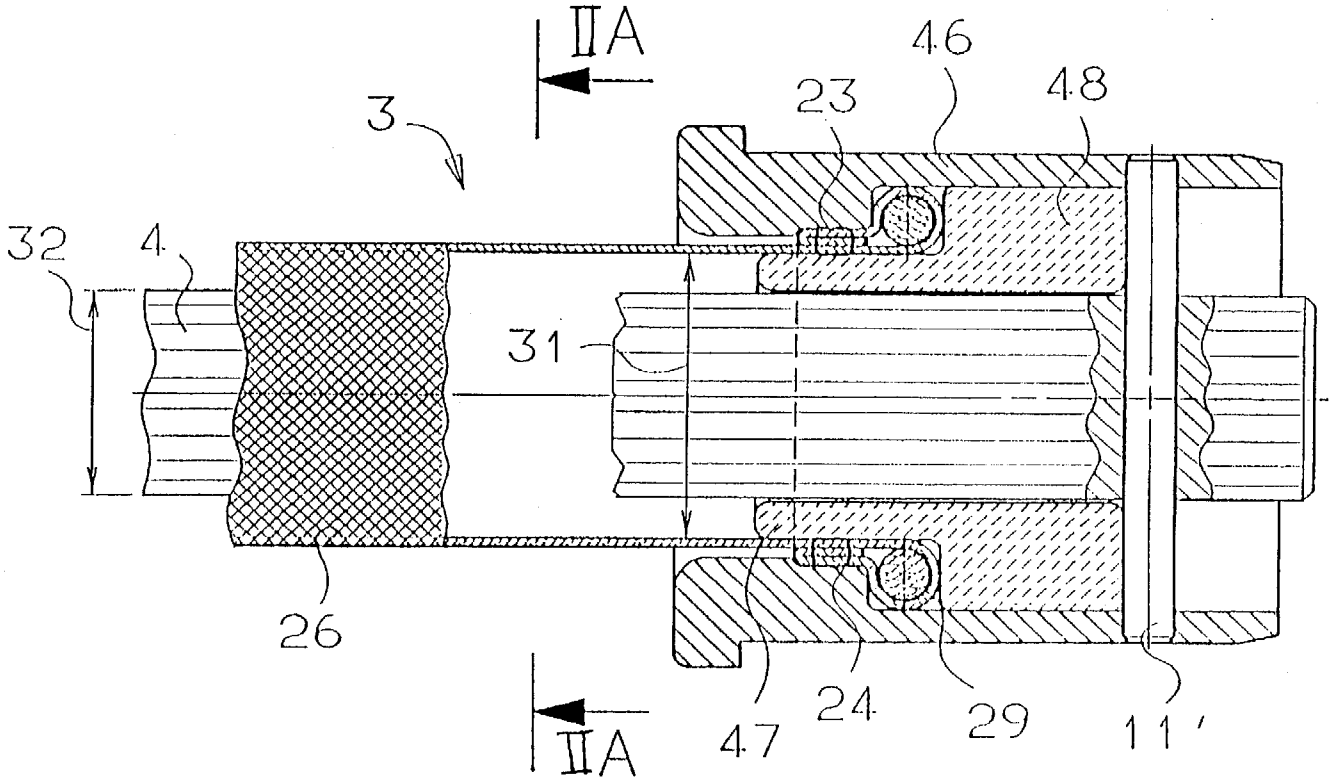

On the left, FIG. 2 shows a filter envelope 26 similar to the type already shown and explained in FIG. 1. Because it was made by means of a knitting process, the circumference and the diameter of the filter envelope 26 can be increased by stretching. An elastic ring 29 made of a plastic material is fastened at the end of the filter envelope 26 by winding the end 23 of the filter envelope 26 from the inside around the ring 29. As indicated by a seam 24, the end 23 is fastened by sewing it to an area of the filter envelope 26 located further back.

The elastic ring 29 is clamped between an outer sleeve 46 and an inner sleeve 48. As a rigid element, the inner sleeve 48 takes the place of the elastic sleeve 8 in accordance with FIG. 1. It has a neck 47 for supporting the end of the filter envelope 26 from the inside and is axially fixed in place by means of a transverse pin 11' which penetrates through the outer sleeve 46 and the drainage core 4.

It is important for the perfect functioning of the drainage process that the interior diameter 31 of the filter envelope 26 is considerably greater than the diameter 32 of the drainage core 4. It is possible by means of this to prevent an otherwise occurring adhesion by shrinking of the filter envelope 26 on the drainage core 4. As FIG. 2 shows, the interior diameter 31 of the filter envelope 26 is increased by winding its ends around the elastic ring 29. However, for assembly it is necessary to push this end through the narrowest opening of the outer sleeve 46, whose diameter is maximally equal to the diameter of the filter envelope corresponding to the diameter 31. This is possible because the ring-shaped bulge 23, 29 is embodied to be deformable in a suitable shape.

Figures 3, 3A:
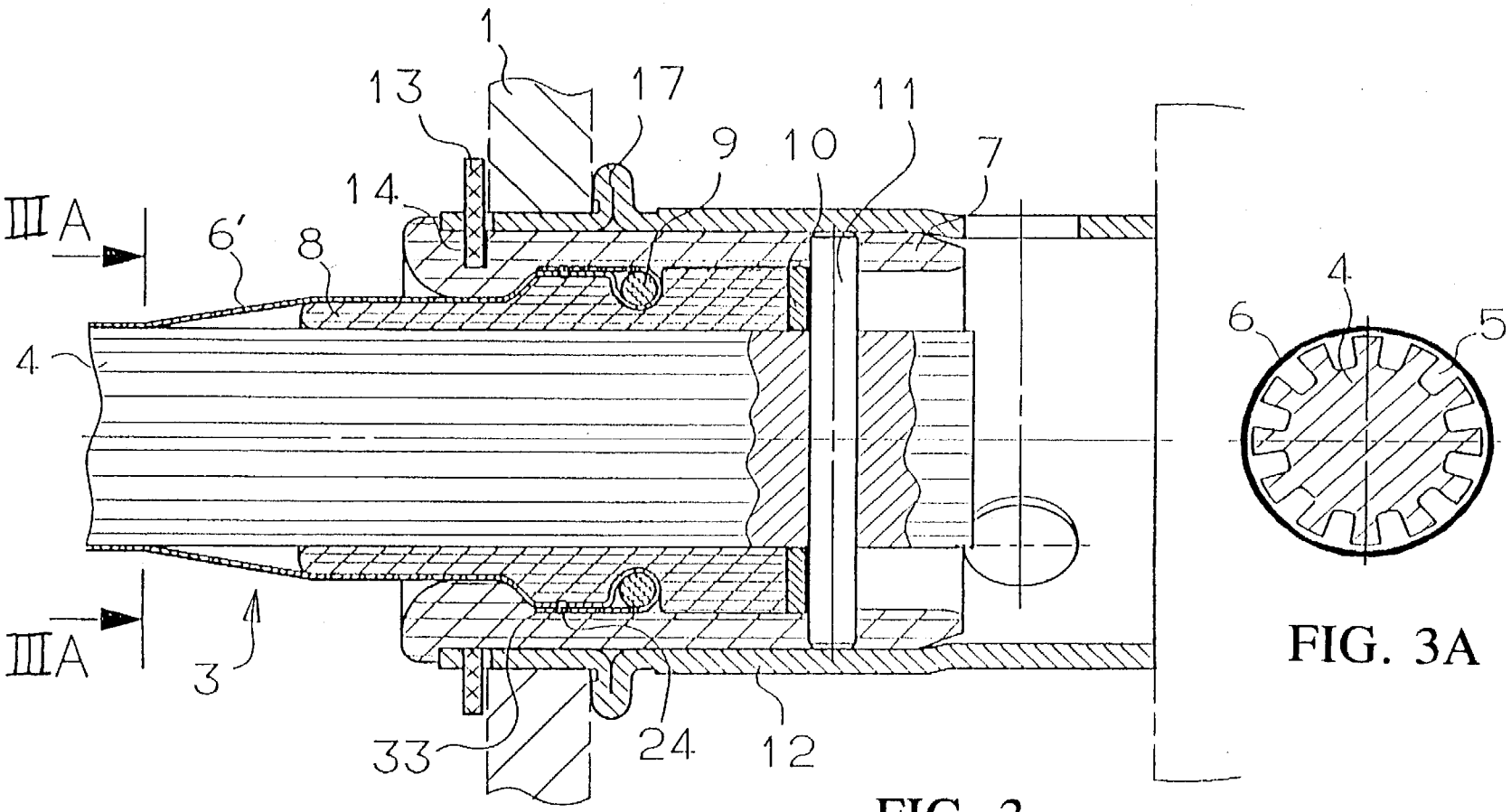
FIG. 3 is a partial sectional view of a portion of a filter envelope provided with a ring-shaped bulge according to one embodiment of the invention.
FIG. 3A is a cross-sectional view along the section line IIIA—IIIA in FIG. 3.

FIG. 3 shows the use of a filter envelope 6' in accordance with the invention with a fastening device of a type known per se as has already been explained in connection with FIG. 1. Components of this fastening device corresponding to FIG. 1 have the reference numerals already provided there. In accordance with FIG. 3, the filter 6' is wound from the inside out around the O-ring 9 the same as in the embodiment in accordance with FIG. 2. The end 33 of the filter envelope 6' is simply fastened by means of a seam 24 to an area further back on the filter envelope 6' by sewing. Because of being made by means of a knitting process, the circumference of the filter 6' is expandable and can therefore, as shown in FIG. 3, adapt itself to the increased diameter of the elastic sleeve 8 in the area of the O-ring 9.

FIG. 4 to FIG. 14 show exemplary embodiments of the filter envelope with a ring-shaped bulge in accordance with the invention in partial sectional views. In accordance with FIG. 4, the filter envelope 26 is wound from the inside out around an elastic ring 29, the same as in the embodiment in accordance with FIG. 2. However, the end 33 of the filter envelope 26 is not wound another turn but is simply fixed in place by a seam 24. In the exemplary embodiment in accordance with FIG. 5, the end 43 is also simply fastened by means of a seam 24, but the end 43 is here wound around the ring 29 from the outside to the inside.

The ring can also consist of a comparatively hard elastic material, as long as its deformability only allows it to be pushed through the opening of the outer sleeve 46, as described in connection with FIG. 2. Such a material is provided in the embodiment in accordance with FIG. 6 of the ring 59. In this case the cross section of the ring 59 is selected to be rectangular and its shape can essentially only be changed in the range between a circle and an oval. The end 53 of the filter envelope 26 is fastened on an area further back of the filter envelope 26 by sewing or ultrasound welding.

To achieve defined shapes of the ring-shaped bulge it is possible to use groups of several rings instead of the rings 9, 29, 59 of FIGS. 2 to 6. FIG. 7 shows a group of two elastic rings 68, 69 around both of which the filter envelope 26 is wound. The fastening of the end 33 of the sleeve 26 in the zone 24 corresponds to that in accordance with FIG. 4. However, in place of the rings 9, 29, 59 it is also possible to employ stranded rings 79 in accordance with FIG. 8 or wire spirals 89 in accordance with FIG. 9 as elastic rings. If sewing or welding is to be omitted when fastening the end 33, 53 of the filter envelope 26, it is also possible to use a further ring 19 in accordance with FIG. 10, or 90 in accordance with FIG. 11 and located on the outside for this. In this case the end 93 or 92 of the filter envelope 26 is practically embodied to be long enough that when fastened on the press in accordance with FIG. 3 it can project toward the right past the end of the filter envelope 6'. Possible brief tightening of the filter envelope 26 then does not result in a loss of the holding effect.

Figure 4:
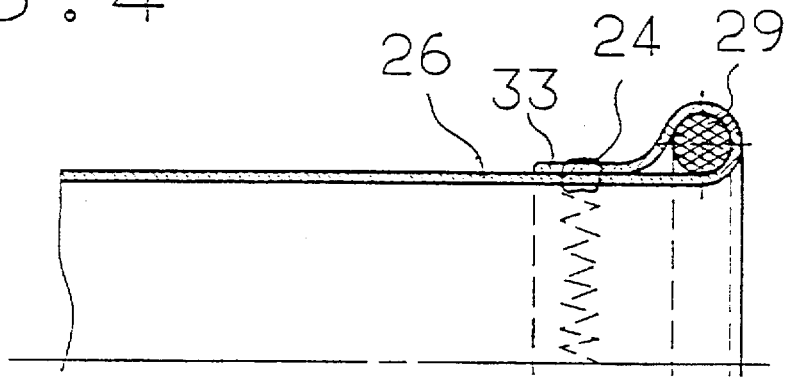
FIG. 4 is a partial sectional view of a portion of a filter envelope provided with a ring-shaped bulge according to another embodiment of the invention.
Figure 5:
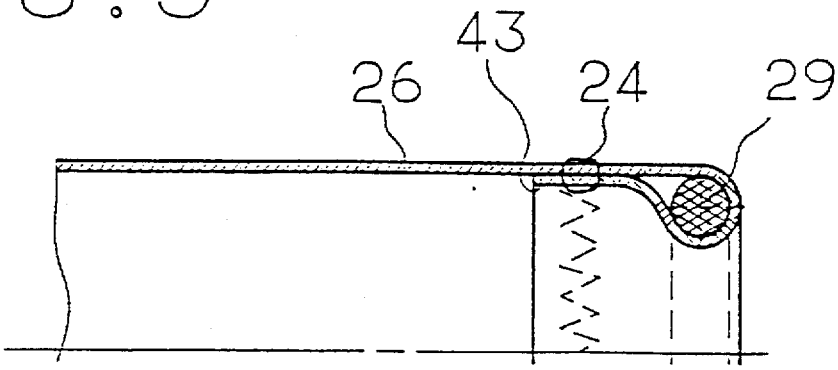
FIG. 5 is a partial sectional view of a portion of a filter envelope provided with a ring-shaped bulge according to another embodiment of the invention.
Figure 6:
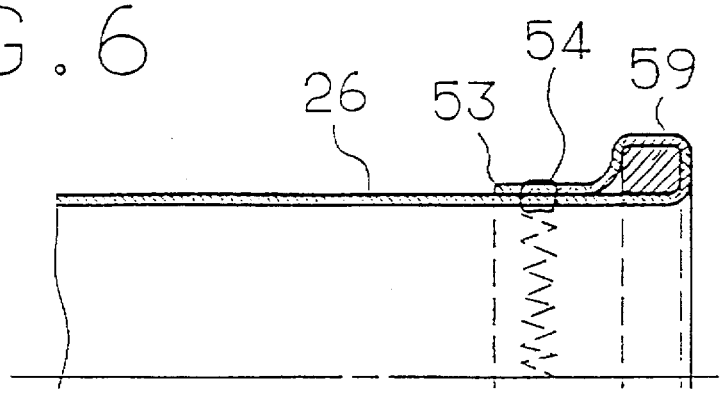
FIG. 6 is a partial sectional view of a portion of a filter envelope provided with a ring-shaped bulge according to another embodiment of the invention.
Figure 7:
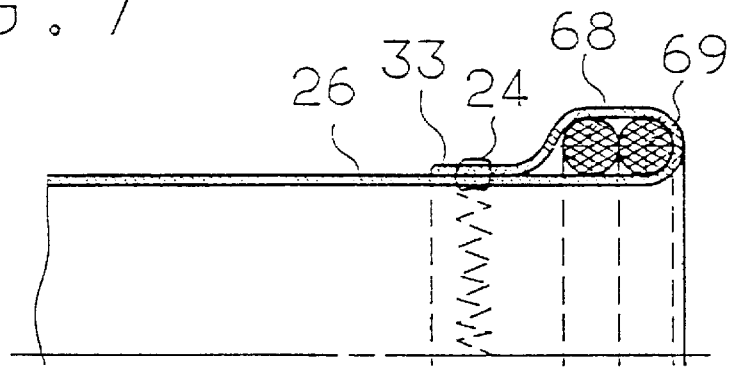
FIG. 7 is a partial sectional view of a portion of a filter envelope provided with a ring-shaped bulge according to another embodiment of the invention.
Figure 8:
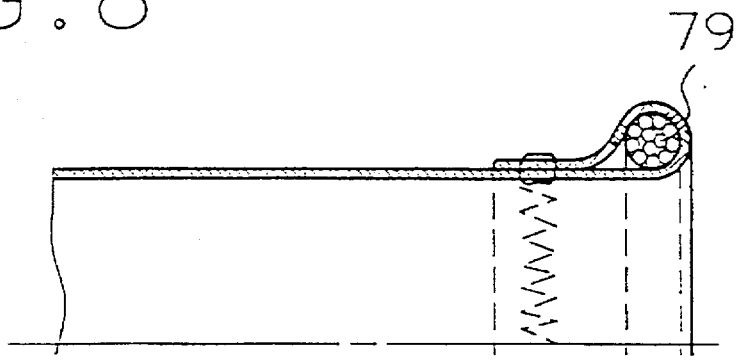
FIG. 8 is a partial sectional view of a portion of a filter envelope provided with a ring-shaped bulge according to another embodiment of the invention.
Figure 9:
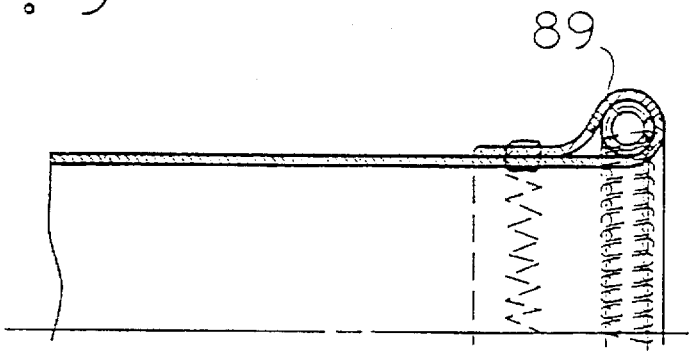
FIG. 9 is a partial sectional view of a portion of a filter envelope provided with a ring-shaped bulge according to another embodiment of the invention.
Figure 10:
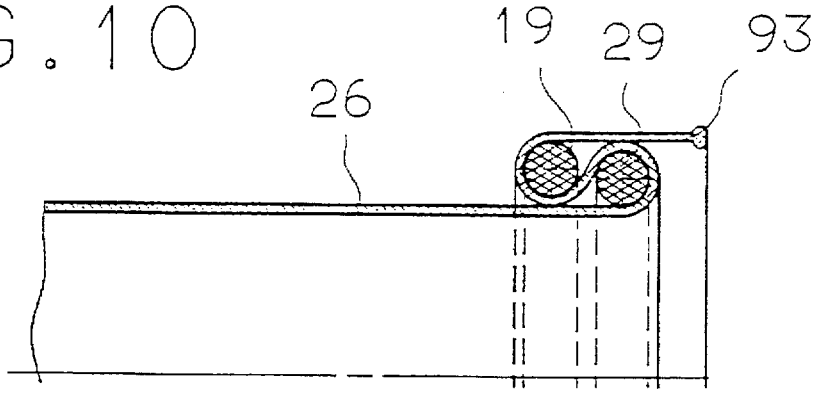
FIG. 10 is a partial sectional view of a portion of a filter envelope provided with a ring-shaped bulge according to another embodiment of the invention.
Figure 11:
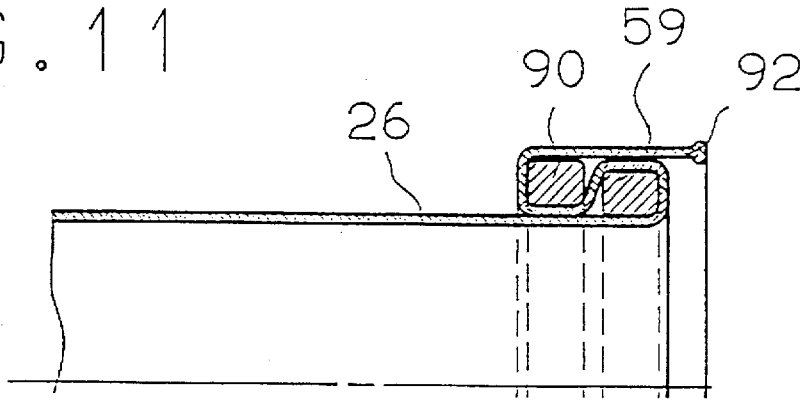
FIG. 11 is a partial sectional view of a portion of a filter envelope provided with a ring-shaped bulge according to another embodiment of the invention.
Figure 12:
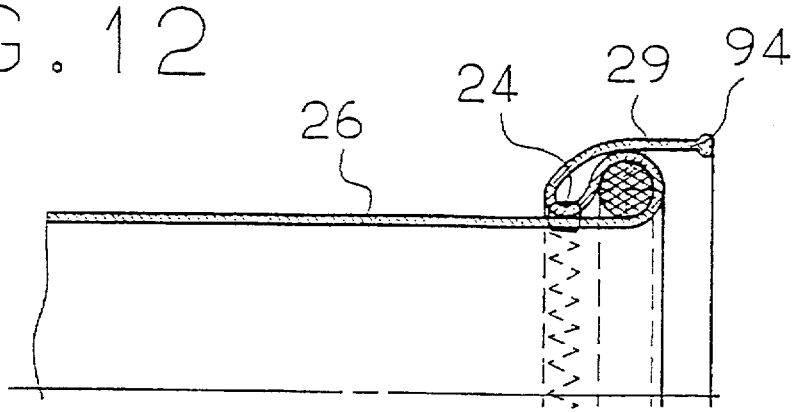
FIG. 12 is a partial sectional view of a portion of a filter envelope provided with a ring-shaped bulge according to another embodiment of the invention.
Figure 13:
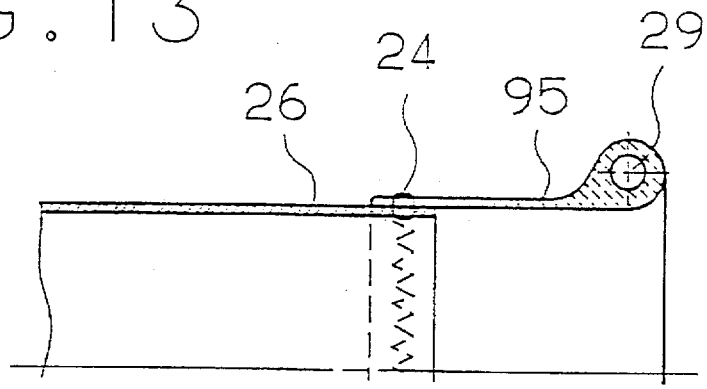
FIG. 13 is a partial sectional view of a portion of a filter envelope provided with a ring-shaped bulge according to another embodiment of the invention.

However, a long embodiment of the end of the filter envelope 26 can also be advantageous if it is fastened in accordance with FIG. 4 or FIG. 6. FIG. 12 shows such a long embodiment of the end 94, which results in an additional security of the fastening. If it is intended to escape the reliance on the material properties of the ringed-shaped bulge when fastening it on the filter envelope, it is possible in accordance with FIG. 13 to first connect an extension 95 to the filter envelope 26, for example by a seam 24. Similar to the way shown in FIG. 4, the extension 95 is wound around a ring 29.

Figure 14:
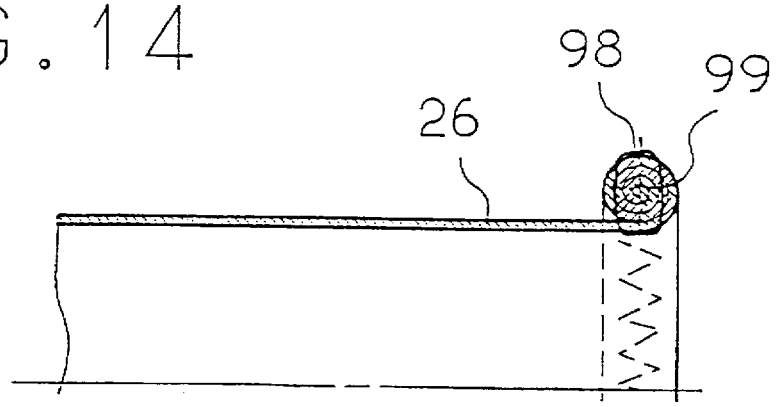
FIG. 14 is a partial sectional view of a portion of a filter envelope provided with a ring-shaped bulge according to another embodiment of the invention.

One or several of the rings of the type shown in FIGS. 2 to 13 can be omitted if, as shown in FIG. 14, the ring-shaped bulge is made on at least one end of the filter envelope 26 by rolling up the filter envelope or an extension connected with it itself and winding the envelope 26 or the extension 95 around it. In this case the rolled-up bulge 99 is secure against coming loose by sewing in a zone 98.

What is claimed is:

1. A filter envelope for a drainage element of a press used to separate fluids from solid materials, wherein the drainage element comprises an elongated flexible drainage core with flow paths for removing pressed-out liquid from a pressing chamber of the press, and wherein at least one end of the drainage element is fastened on a portion of the press, said filter envelope comprising a fluid-permeable filter element and at least one annular bulge which is fixedly connected to the fluid-permeable filter element at its one end by being surrounded by the filter element, said annular bulge being deformable to permit the one end of the filter element to be pushed through an opening in a fastening element whose diameter is maximally equal to the diameter of the filter element in its form in which it is fastened on the press.

2. The filter envelope in accordance with claim 1, wherein the annular bulge is a ring, a portion of the filter element at the one end of the filter element being wound around the ring and being fastened to the filter element at a fastening region located in front of the ring.

3. The filter envelope in accordance with claim 2, wherein the ring is an O-ring.

4. The filter envelope in accordance with claim 2, wherein the ring is a wire spiral.

5. The filter envelope in accordance with claim 2, wherein the ring has a rectangular cross section.

6. The filter envelope in accordance with claim 2, wherein the ring is elastically deformable so that its shape can essentially only be changed between a circle and an oval.

7. The filter envelope in accordance with claim 2, wherein the ring is made of a stranded material.

8. The filter envelope in accordance with claim 2, wherein a portion of the filter element at the one end of the filter element is wound around the ring so that an inner surface of the filter element faces the ring.

9. The filter envelope in accordance with claim 2, wherein the portion of the filter element that is wound around the ring is fastened to an area of the filter element in front of the ring by sewing.

10. The filter envelope in accordance with claim 2, wherein the one end of the filter element that is wound around the ring is fastened to an area of the filter element in front of the ring by ultrasound welding.

11. The filter envelope in accordance with claim 2, wherein the filter element includes a free end that extends beyond the ring so that the ring is located axially between the free end of the filter element and the fastening region.

12. The filter envelope in accordance with claim 2, wherein said ring is a first ring and including a second ring, a portion of the filter element at the one end of the filter element being wound around the first and second rings so that an exterior surface of the filter element faces the first ring and an interior surface of the filter element faces the second ring.

13. The filter envelope in accordance with claim 1, wherein the annular bulge is composed of a plurality of rings and a portion of the filter element at the one end of the filter element is wound around the rings and fastened on an area of the filter element located in front of the rings.

14. The filter envelope in accordance with claim 1, wherein the annular bulge is formed by rolling up and sewing a portion of the filter element at the one end of the filter element.

15. The filter envelope in accordance with claim 1, wherein the filter element includes an extension connected to the filter element.

16. A drainage element of a fruit press for separating fluids from solid materials, the drainage element being positionable in a core holder, the drainage element comprising a fluid-permeable filter element and an elongated drainage core having an outer periphery provided with a plurality of flow paths for guiding and removing press-out liquid during a pressing operation, the filter element being positioned over the drainage core, and an annular bulge provided at one end of the filter element, the annular bulge being surrounded by a portion of the filter element, said annular bulge being deformable to permit the one end of the filter element to be pushed through an opening in the core holder.

17. The drainage element in accordance with claim 16, wherein the filter element includes an extension connected to the filter element.

18. The drainage element in accordance with claim 16, wherein the annular bulge is an elastic ring, the portion of the filter element surrounding the annular bulge being wound around the ring and fixed to the elastic element at a fastening region located in front of the ring.

19. The drainage element in accordance with claim 16, wherein the annular bulge is composed of a plurality of elastic rings.

20. The drainage element in accordance with claim 16, wherein the annular bulge is formed by rolling up and sewing a portion of the filter element at the one end of the filter element.

* * * * *